US011548721B2

(12) United States Patent
Fernandes De Carvalho et al.

(10) Patent No.: US 11,548,721 B2
(45) **Date of Patent: *Jan. 10, 2023**

(54) METHOD FOR PRODUCING A BEVERAGE USING A PORTION PACK, AND PORTION PACK

(71) Applicant: MELITTA SINGLE PORTIONS GMBH & CO. KG, Minden (DE)

(72) Inventors: Kerstin Fernandes De Carvalho, Bielefeld (DE); Jan Pahnke, Minden (DE); Gerold Schandl, Minden (DE); Holger Feldmann, Willich (DE)

(73) Assignee: MELITTA SINGLE PORTIONS GMBH & CO. KG, Minden (DE)

( * ) Notice: Subject to any disclaimer, the term of this patent is extended or adjusted under 35 U.S.C. 154(b) by 144 days.

This patent is subject to a terminal disclaimer.

(21) Appl. No.: 16/961,237

(22) PCT Filed: Jan. 22, 2019

(86) PCT No.: PCT/EP2019/051523

§ 371 (c)(1),
(2) Date: Jul. 9, 2020

(87) PCT Pub. No.: WO2019/141872

PCT Pub. Date: Jul. 25, 2019

(65) Prior Publication Data

US 2021/0061547 A1 Mar. 4, 2021

(30) Foreign Application Priority Data

Jan. 22, 2018 (DE) ..... 102018101338.8

(51) Int. Cl.
*B65D 85/804* (2006.01)

(52) U.S. Cl.
CPC ..... *B65D 85/8043* (2013.01); *B65D 85/8046* (2013.01); *B65D 85/8061* (2020.05)

(58) Field of Classification Search
CPC ..... B65D 85/812; B65D 85/3102; B65D 85/8061; B65D 85/8043; B65D 85/8046
See application file for complete search history.

(56) References Cited

U.S. PATENT DOCUMENTS 2,234,397 A 3/1941 Bentz
4,560,475 A 12/1985 Kataoka
(Continued)

FOREIGN PATENT DOCUMENTS

CN 101678952 A 3/2010
DE 69013577 T2 3/1995
(Continued)

OTHER PUBLICATIONS

Himbas, EP 2752375, Machine Translation. (Year: 2014).*
(Continued)

*Primary Examiner* — Drew E Becker
*Assistant Examiner* — Chaim A Smith
(74) *Attorney, Agent, or Firm* — FisherBroyles, LLP; Robert Kinberg

(57) ABSTRACT

A method for producing a beverage using a portion pack including a container made of filter material for containing an extraction material, and a supporting body which encloses the container. The method comprises the steps of: placing the closed portion pack into a filter vessel; opening the container of the portion pack on an upper side and increasing the internal volume of the container by at least 50% compared to the internal volume in the closed container; and applying water to the extraction material for beverage preparation. The portion pack comprises at least one folding edge on the supporting body about which a flap can be pivoted in order to increase the internal volume of the portion pack when opening.

13 Claims, 12 Drawing Sheets

(56) References Cited

U.S. PATENT DOCUMENTS 5,059,325 A * 10/1991 Iida ..... A47J 31/02
210/474
5,605,710 A 2/1997 Pridonoff et al.

FOREIGN PATENT DOCUMENTS

| | | | |
|---|---|---|---|
| DE | 19520837 | A1 | 12/1996 |
| DE | 102013200114 | A1 | 7/2014 |
| EP | 0268847 | B1 | 6/1988 |
| EP | 0401951 | B1 | 12/1990 |
| EP | 2752375 | A1 | 7/2014 |

OTHER PUBLICATIONS

German Search Report in corresponding German Patent Application No. 10 2018 101 338.8, received Jul. 19, 2018, 14 pages with google English translate.
International Search Report in corresponding International Patent Application No. PCT/EP2019/051523, dated May 9, 2019, 2 pages English translation.
Chinese First Office Action in related Chinese Patent Application No. 201980009664.5, dated Sep. 3, 2021, 10 pages.

* cited by examiner

METHOD FOR PRODUCING A BEVERAGE USING A PORTION PACK, AND PORTION PACK

CROSS-REFERENCE TO RELATED APPLICATIONS

This application is a U.S. National Stage of International Patent Application No. PCT/EP2019/051523 filed on Jan. 22, 2019, which claims benefits of German Patent Application No. 10 2018 101 338.8 filed Jan. 22, 2018.

TECHNICAL FIELD

The present invention relates to a method for producing a beverage with a portion pack comprising a container made of filter material, in which an extraction material is arranged, and a supporting body surrounding the container. The invention also relates to a portion pack comprising a container made of filter material, in which an extraction material is to be arranged, and a supporting body surrounding the container at least in part, wherein the container is closed in an initial position and is openable by pivoting at least a part of the edge of the filter material.

BACKGROUND OF THE INVENTION

For the preparation of coffee, there are filters which, according to EP 268 847 B1, have a cardboard holding frame which can be placed on a container and a filter bag made of filter paper. This allows the filter bag to be held in a predetermined position by the holding frame, so that the user fills the filter bag to brew coffee and then performs a brewing operation. Although the individual filling of the filter paper and manual brewing allows the coffee taste to be individually taken into account during preparation, grinding and filling the filter bag with ground coffee and subsequent manual brewing is comparatively complex.

DE 195 20 837 A1 shows a portioned coffee filter bag with ground coffee, which may be formed in a vacuum-packed manner and is ready for use after removal from the packaging. Such portion packs are known in many forms and have the disadvantage that the needs are not sufficiently taken into account when preparing coffee. When brewing coffee, the volume of the ground coffee increases and, unlike when making espresso under high pressure, the ground coffee should be able to extend when the coffee is poured over with hot water from above. In addition, a defined ground coffee bed geometry and an even wettening of the ground coffee are required when producing high-quality coffee drinks, which is often not achieved with conventional portion packs.

The EP 401 951 B1 reveals a filtering device with a paper filter bag and a supporting body that can be placed on a cup to perform a manual brewing operation.

SUMMARY OF THE INVENTION

It is therefore an object of the present invention to provide a method for the production of a beverage as well as a portion pack therefor, by means of which a simple preparation is possible, wherein the transport volume of the portion pack in the closed position should be small, while the volume of the portion pack should not restrict the preparation.

is The above and other objections are solved according one embodiment of the invention wherein there is provided a method for producing a beverage with a portion pack comprising a container made of filter material in which an extraction material is arranged and a supporting body surrounding the container, wherein the supporting body includes at least one flap hinged to a folding edge of the supporting body, an upper section of the filter material is fixed to the at least one flap, and the at least one flap has a folded position in which the upper section of filter material covers an upper side of the container rendering a closed portion pack, the method comprising the steps of: inserting the closed portion pack into a filter vessel; opening the container of the portion pack by pivoting the at least one flap to which the upper section of the filter material is fixed from the folded position to an open position which opens the upper side of the container thereby increasing the inner volume of the container by at least 50% compared to the inner volume in the folded position of the at least one flap; and applying water to the extraction material for beverage preparation.

In another embodiment of the method according to the invention, a closed portion pack is inserted into a filter vessel and, before or after the insertion of the portion pack, the container of the portion pack is opened at an upper side, wherein the inner volume of the container is increased by at least 50% compared to the inner volume in the closed position. In the closed position of the container, the inner volume is defined by the interior of the container, which is surrounded by the filter material, while in the open position the inner volume is defined by the filter material which has an upper edge in the open position. This edge forms a horizontal plane and thus constitutes the upper limit of the inner volume. If the upper edge is profiled or has protrusions and recesses, an average value of the upper edge with respect to the vertical height is formed in order to use it for calculating the inner volume. The inner volume thus formed in the open position is preferably at least 50% larger than the inner volume in the closed position, so that when the beverage is prepared by applying water to the extraction material, the extraction material is not compressed but can outgas and swell without being spatially restricted. If the extraction material, in particular the ground coffee, is uniformly moistened, a high-quality coffee can thus be brewed.

The supporting body has at least one folding edge around which a flap can be pivoted, to which an upper section of filter material is fixed. This means that one or more flaps of the supporting body can be used for an opening process of the portion pack. For opening, the portion pack can be moistened in the area of the folding edges so that the portion pack can open automatically.

The supporting body may have several flaps on one upper side of the container in the closed position, which are connected to a section on a side wall of the container via folding edges. By moistening the folding edges, a swelling process can be set in motion, which leads to a deformation and to a swinging open of the flaps on the upper side of the container. The supporting body is preferably provided in a ring shape at an upper edge of the container in the closed position, so that by wetting the upper side of the portion pack with water, the closure means can optionally be loosened and in particular a deformation process is initiated which causes the flaps to swing open. The supporting body preferably consists of a material swellable by water, such as cardboard or a thick paper, so that a swelling process at a folding edge provides for corresponding pivoting movements at the flaps.

In an embodiment of the portion pack according to the invention, the supporting body may have at least one folding edge around which a flap can be pivoted in order to increase the inner volume of the container by at least 50% when it is opened. Several flaps may be provided along a circumferential folding edge, which are then pivoted during opening.

For effective production, the container with the supporting body in the closed position has an angular shape when viewed from above, in particular a pentagonal to octagonal shape, for example hexagonal. This means that a folding edge can be provided between the individual corners of the container, on each of which a flap is pivotably mounted.

The bottom of the container may have a tip of filter material that is not covered by the supporting body. This means that only the filter material which can be passed through during the preparation of the beverage is provided in a lower area, so that the supporting body does not impede the preparation process for the beverage. The tip may be frustoconical or pyramid-shaped, wherein the area not covered by the supporting body occupies at least 30% of the height of the portion pack in the preparation position. In the use position with the tip of the portion pack facing downwards, the height is measured in the vertical direction.

To increase the effective filter area, spacers, for example ribs, profiles, embossed portions or cut-outs, can be attached to the supporting body. This allows the supporting body to be positioned exactly in a filter vessel via the spacers. The filter material can be held at a distance from a filter vessel in the lower area.

The filter material can preferably be unfolded together with the supporting body on the upper side, wherein supporting body and filter material are glued together or mechanically fixed to each other for this purpose. The filter material is folded in an initial position on an upper side of the container, i.e. it is arranged in several layers at least in some areas, and can be held by the supporting body and/or the closure means. After releasing the closure means, the filter material can then be pivoted with the flaps of the supporting body so that the area of the filter material which, in an initial position, forms an upper cover for the portion pack, forms a side wall after opening and pivoting, so that the extraction material contained in the portion pack can expand accordingly during preparation.

In an embodiment of the method according to the invention, the portion pack is first placed in a device for preparing beverages, and then water is applied to the portion pack and a closure means provided on the portion pack is dissolved by moistening with water. The portion pack can be opened and a supporting body of the portion pack unfolded by dissolving the closure means. Water is then applied to the extraction material arranged in the container for beverage preparation, so that the beverage preparation takes place in an open position of the portion pack and the extraction material can expand accordingly.

In an embodiment, hot water is used to dissolve the closure means, for example water that is between 70° and 100° hot. This hot water can be used both to dissolve the closure means and to unfold the supporting body by initiating local swelling processes by sucking up water, which leads to unfolding. An initial quantity of water is used to dissolve the closure means and open the portion pack, for example 5 ml to 100 ml, in particular 10 ml to 50 ml. This water can be used in particular for the preparation of coffee in addition to pre-wetting, swelling and degassing. This is also known as pre-brewing. After opening, a second quantity of water, especially hot water, is added for beverage preparation. The second quantity of water may then comprise, for example, 100 ml to 500 ml, in particular 150 ml to 250 ml, depending on the quantity of beverage prepared.

When opening the portion pack, the flaps of the supporting body on one upper side of the container are preferably pivoted between 90° and 180°, in particular between 110° and 150°, so that the extraction material is freely accessible from above and can expand upwards accordingly. The additional volume created by opening the flaps is at least as large, typically more than twice the original volume of the closed portion pack. The additional volume can also be used by the solvent. When preparing coffee, for example, a dispersion of ground coffee and water is created.

In a preferred design, the pivotable flaps are arranged in at least two planes one on top of the other at least in the area of the closure means in the closed position of the portion pack in order to make the closure of the portion pack particularly stable.

The invention is explained in more detail below with reference to several embodiment shown in the attached drawings, wherein:

DETAILED DESCRIPTION OF THE INVENTION

Figure 1:
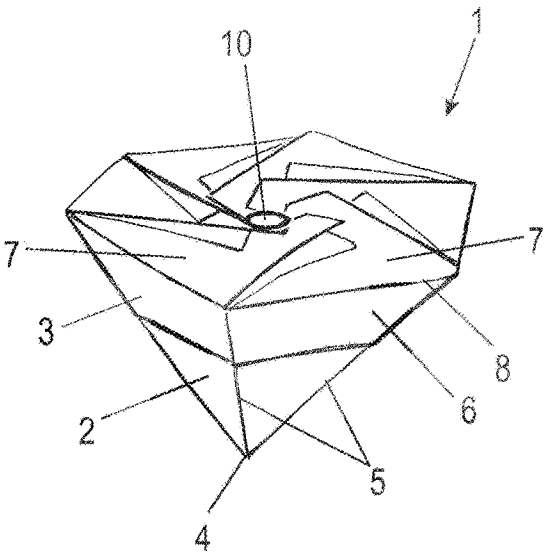

A portion pack 1 comprises a container 2 made of filter material, which has a lower tip 4 from which side walls extend widening upwards. In the closed position shown in FIG. 1, a supporting both 3 is located at an upper edge of container 2 and surrounds it in a ring shape. The supporting body 3 is only provided in the area of an upper edge of the portion pack 1, while the downwardly projecting tip is not covered by the supporting body 3.

Figure 9:
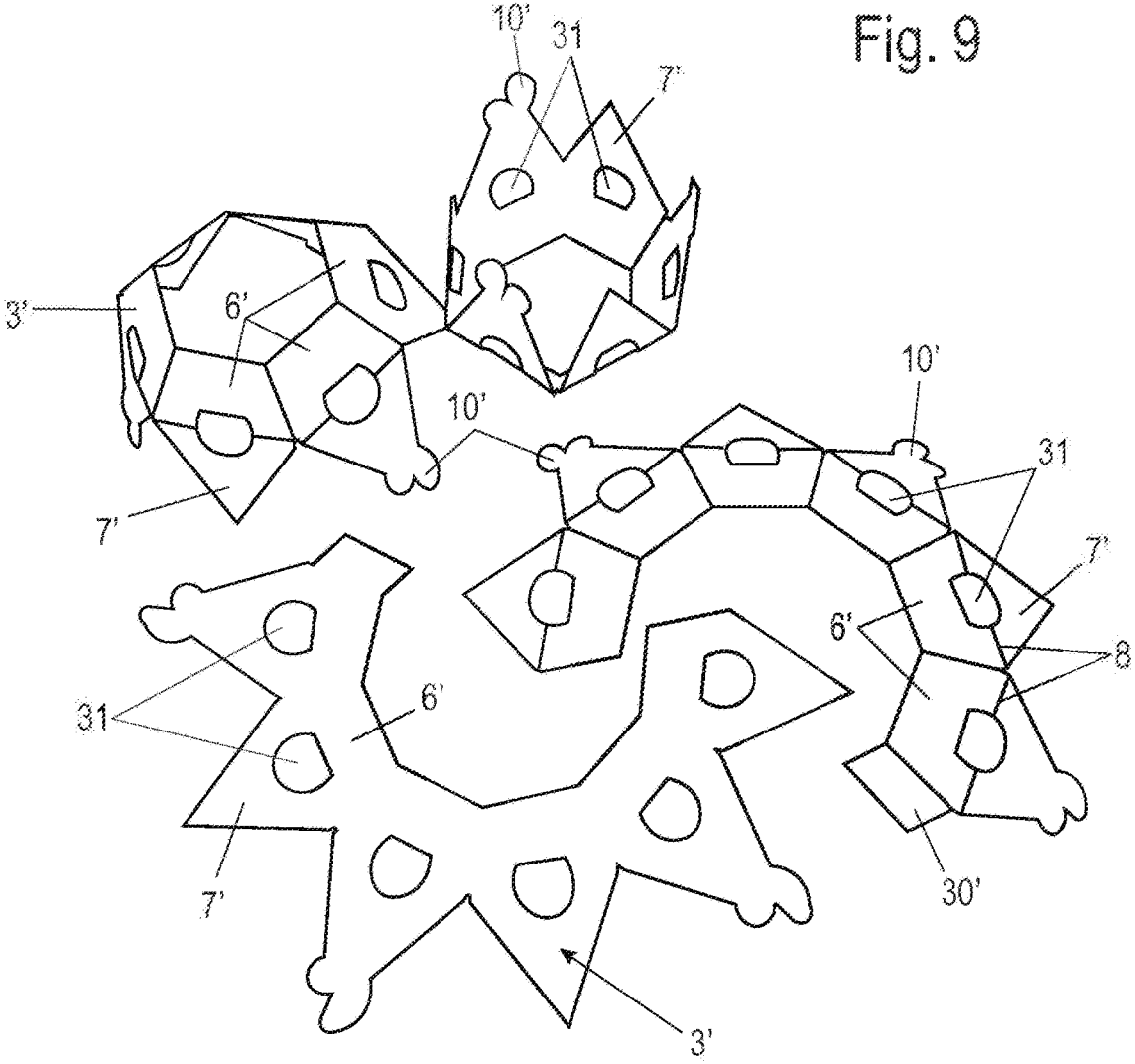
FIG. 9 shows views of a modified supporting body for a portion pack with integrated closure element.

The container 2 is pyramid-shaped and, starting from the tip 4, comprises several spreading side surfaces which are connected to each other by side edges 5. The supporting body 3 is of annular design in the region of these side surfaces and comprises sections 6 which cover the side surface at least in the upper region which is preferably designed to be less than 50%, in particular 25-40%, of the total height of the closed portion pack 1, wherein the height direction in the position of use is preferably aligned vertically. These sections 6 are connected via folding edges 8, collectively defining a "circumferential folding edge," to form a plurality of pivotable flaps 7 which, in an initial position, are arranged substantially horizontally on an upper side of the portion pack 1, wherein the flaps 7 can optionally also be oriented inclined to the horizontal. At least the portion pack 1 is closed in an initial position, wherein a closure means 10 is provided for this purpose, which is designed as a retaining means and holds the flaps 7 together in a central region. For this purpose, the closure means can be designed, for example, as a flat element which is glued to the tips of the flaps 7, preferably with an adhesive approved for the preparation of foodstuffs. In a further embodiment, the closure means can also be designed as a mechanical latching means which is integrated into the geometry of the supporting body, as shown in FIG. 9 and described below.

Figure 2:
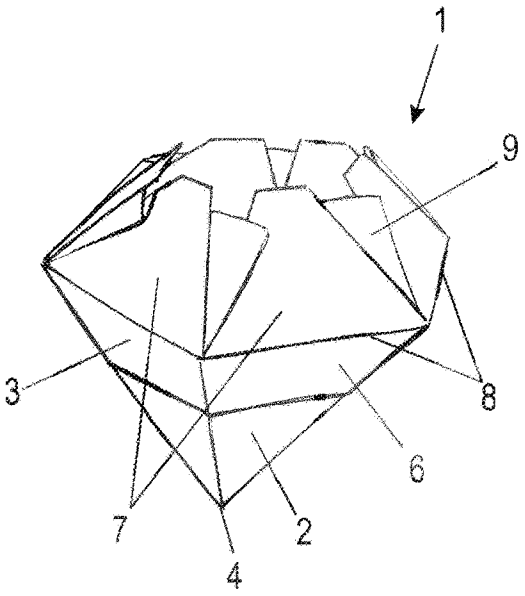

FIG. 2 shows a central opening position of the portion pack 1. By releasing the closure means 10, the flaps 7 of the supporting body can be pivoted around the folding edges 8, wherein an upper section of the filter material of the container 2 is fixed to the flaps 7. The filter material is formed in a folded manner in the upper section in the closed position and can then be unfolded by pivoting the flaps 7.

Figure 3:
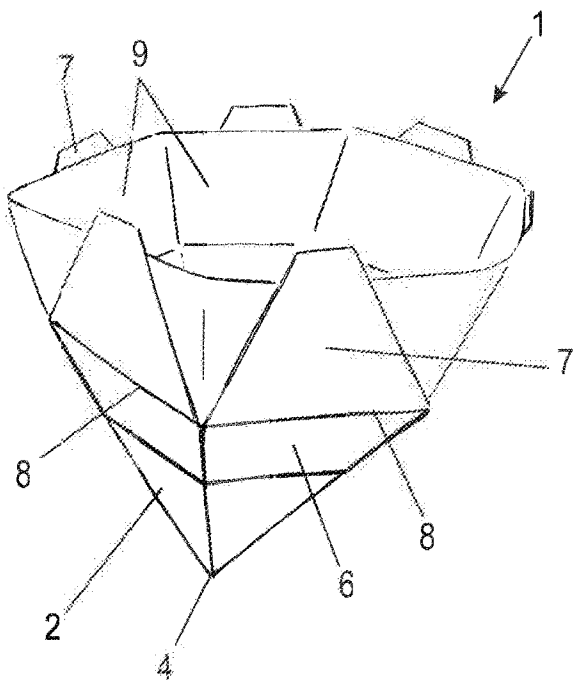
FIGS. 1 to 3 show several views of a portion pack in different positions.

In FIG. 3, portion pack 1 is shown in an open position in which flaps 7 have been pivoted through approximately 130°, i.e. between 110° and 150°, and as a result an upper section 9 of the filter material, which is fixed to the flaps 7 at least in some areas, has also been pivoted. In this opening position, the extraction material arranged in the position pack 1 is accessible from above and can, for example, be doused with hot water.

Figure 4:
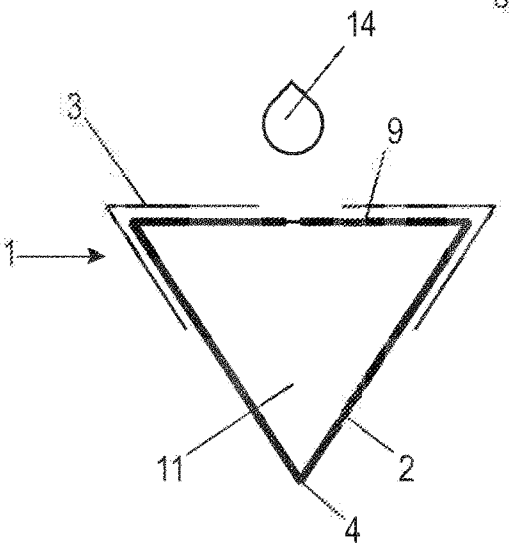
FIG. 4 shows a schematic view of a portion pack in a closed initial position.

In FIG. 4, portion pack 1 is shown schematically to illustrate the process of beverage preparation. Portion pack 1 contains extraction material 11, especially ground coffee. The container 2 made of filter material is essentially triangular in sectional view and comprises a lower tip 4 and an upper section 9, which is essentially horizontal. A first quantity of water, in particular hot water, for example between 10 ml and 50 ml, as shown schematically by the drop 14, can dissolve a closure means 10 placed on the upper side of the portion pack 1. Moistening with water can loosen the adhesive, weaken the material of the closure means until it fails or reduce the stiffness of a plug connection so that no more holding forces can be generated by the closure means.

The first quantity of water is preferably large enough to allow the liquid to spread on the upper side of the portion pack 1 so that the supporting body 3 can also at least partially absorb water. The supporting body 3 is preferably made of cardboard or thick paper.

Figure 5:
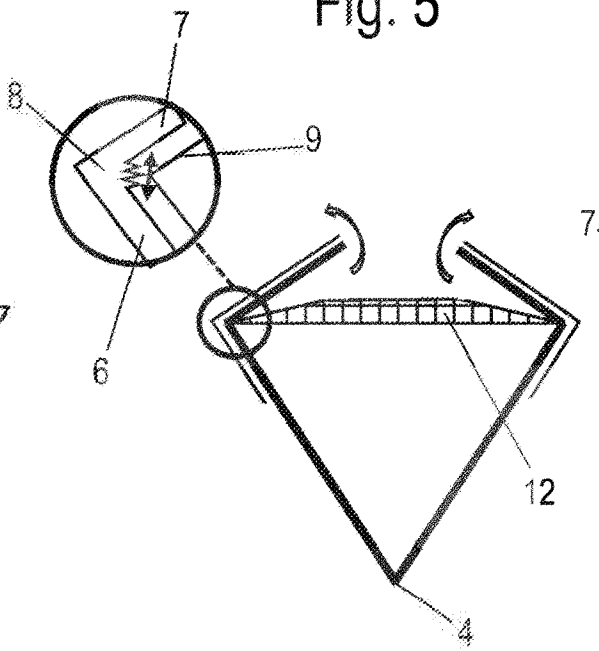
FIG. 5 shows a schematic view of the portion pack of FIG. 4 during the opening process.

As shown in FIG. 5, a local swelling process can be created at an upper folding edge 8 of the supporting body by wetting it with water, which causes an inner side of the folding edge to swell, so that a flap 7 pivots relative to section 6. The swelling is achieved by compressing the material of the supporting body 3 on the inside of the folded edge and by increasing its volume by absorbing water.

By pivoting the flaps 7, the portion pack 1 is opened upwards and hot water can now be applied to the extraction material 11, especially for making coffee or tea. The swelling of the extraction material increases its volume, in the drawing this is shown by the upper area as additional volume 12. The steps of pre-moistening, swelling and degassing are particularly important when preparing high-quality coffee.

Figure 6:
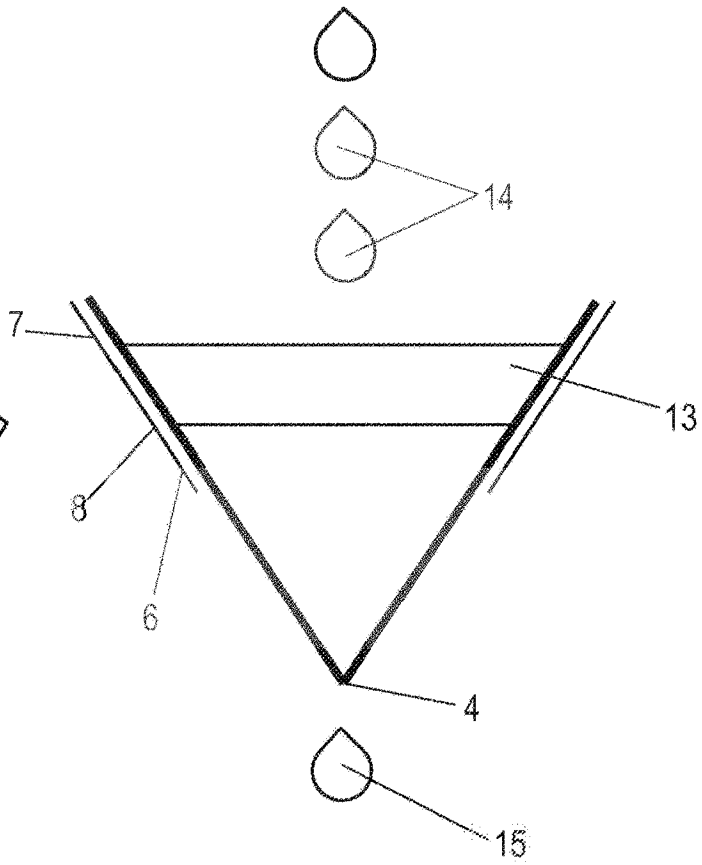
FIG. 6 shows a schematic view of the portion pack of FIG. 4 during the preparation of beverages.

In FIG. 6, the brewing process for preparing beverages is shown schematically. A second quantity of water according to the drop 14 is applied from above to the portion pack 1 in order to brew the extraction material 11, especially ground coffee. The extraction material can increase in size towards the upper side and also disperse with the solvent, as occurs particularly with ground coffee during the brewing process. This is shown in the drawing as additional volume 13, which exceeds the volume of the dry ground coffee. The filtered beverage 15 emerges from the side walls, collects at the bottom, symbolized by the drop, and can be collected in a cup, for example. After preparing the drink, the user can easily grasp the portion pack by the flaps 7 and dispose of it.

Figure 7:
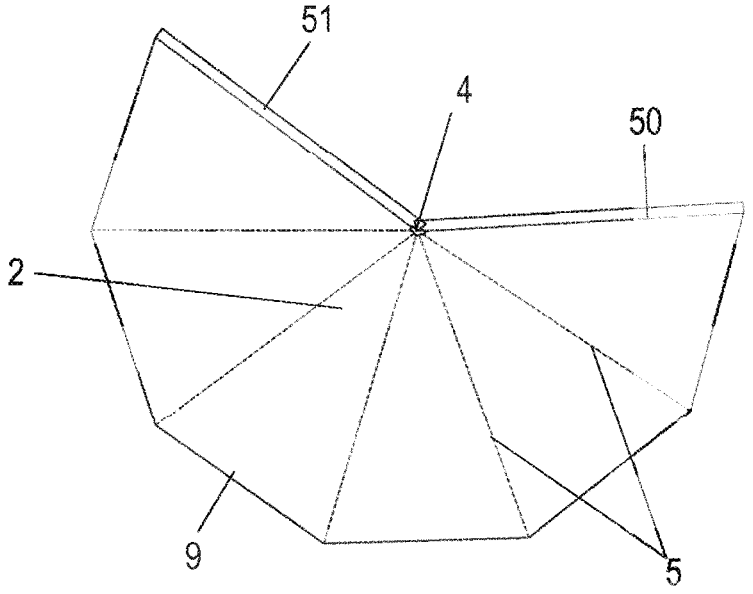
FIG. 7 shows a view of a cut-out of the filter material for a portion pack.

FIG. 7 shows a cut of the filter material before it is made into a container 2. In a flat position, the filter material is essentially circular in shape, with straight edges instead of a rounded circumference on the outer circumference, wherein arcs may alternatively be provided instead of the edges. In any case, the cut-out of filter material has two edge strips 50 and 51, which meet at a tip 4 and are joined together, for example by gluing or embossing, to obtain a shell-, cone- or pyramid-shaped basic shape. The filter material consists preferably of filter paper.

Figure 8:
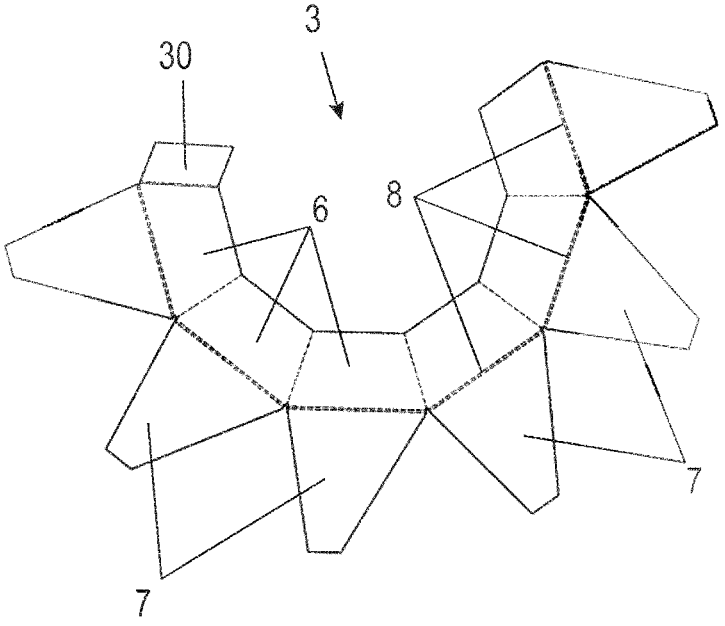
FIG. 8 shows a view of a cut-out of a support for a portion pack.

FIG. 8 shows a cut-out of the supporting body 3 in flat condition. The supporting body 3 comprises an open ring-shaped section on which outwardly projecting flaps 7 are provided. The flaps 7 are V-shaped or cone-shaped and taper outwards. The flaps 7 are connected to contiguous sections 6 via folding edges 8, wherein an edge section 30 is formed on one end section 6, which is connected to a section 6 at the opposite end, in particular by gluing, sealing or embossing, in order to produce an annular supporting body 3. The flaps 7 can then be joined at least in some areas to the upper section 9 of the filter material to produce a portion pack 1, again preferably by the joining techniques of gluing, sealing or embossing.

FIG. 9 shows a modified material cut-out of a supporting body 3', which is shown in different positions and assembly conditions. The supporting body 3' is formed in a flat manner in an initial position and comprises contiguous sections 6' on an inner circumference forming an open ring. From the sections 6', flaps 7' protrude outwardly, which are V-shaped, with a recess 31, also referred to herein as a "cutout", formed on each flap. To produce a supporting body 3', the flat cut-out is first provided with folding edges 8, so that the flaps 7' are pivotably mounted on the sections 6'. On individual flaps 7', projections 10' are formed as closure means, which protrude at the ends of the flaps 7'. When the supporting body 3' has been formed into a ring over an edge section 30', it is arranged on a container 2 made of filter material, which is filled with an extraction material, in particular ground coffee. The flaps 7', which may be at least partially connected to the section 9 of the filter material, are then pivoted into a closed position, in which case the closure means is formed by the projections 10' which provide mechanical locking of the portion pack. This can eliminate the need for an additional element and the use of adhesive. In this embodiment example, the opening of the portion pack is also performed by the use of hot water applied to an upper side of the portion pack so that swelling processes at the supporting body 3', especially in the area of the folding edges 8, partly in combination with pretensions in the supporting body, ensure that the flaps 7' overcome the holding forces by the projections 10' and then pivot. The opening process can be influenced by modifying the recesses 31.

In order to optimize the opening speed, between 20% and 50% can be recessed on the surrounding folding edge 8. If there are no recesses on the folding edge 8 as in FIG. 8, the flaps 7 will open, but at a slower speed than with recesses as shown in FIG. 10.

In the embodiment example shown, the portion packs are intended for making coffee. Of course, it is also possible to make other beverages, especially tea or mixed coffee beverages. By opening the portion pack, the extraction material used can expand and swell without causing problems in the preparation of the beverage. Furthermore, completely soluble extraction material can also be used, in the production of cocoa drinks, for example, the filter element ensures that no undissolved lumps end up in the beverage.

Figure 10:
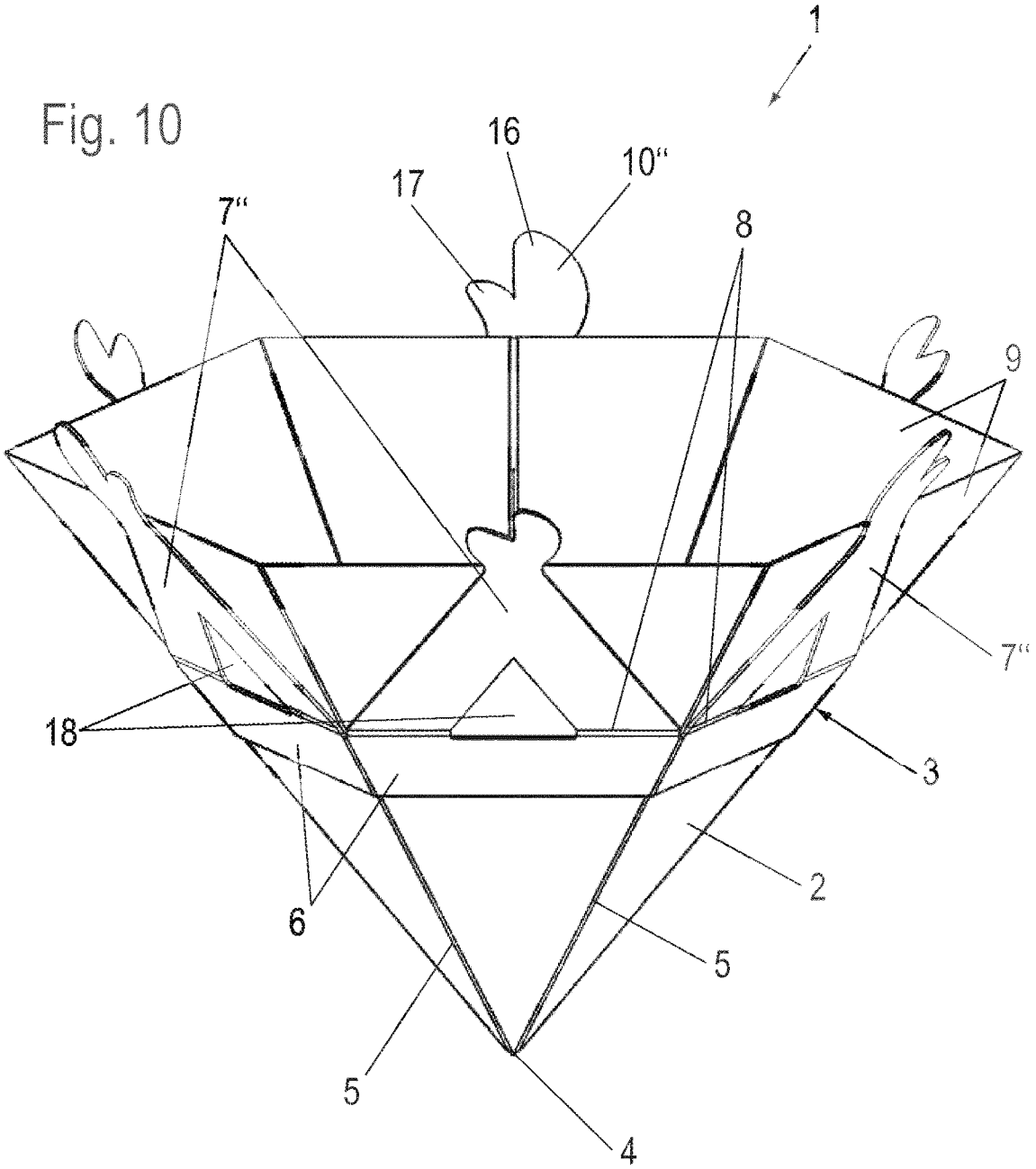
FIG. 10 shows a perspective view of a portion pack in an open position according to another embodiment example.

FIG. 10 shows a portion pack in an open position according to another embodiment example. As in the previous embodiment examples, the portion pack 1 comprises a container 2 made of a liquid-permeable filter material, in particular filter paper, around which a supporting body 3 is arranged in a ring shape. The container 2 is substantially pyramid-shaped with a tip 4 arranged at the bottom in the position of use, from which several side walls of filter material are arranged spreading upwards, which are connected to one another via side edges 5.

The supporting body 3 may be made of cardboard or thicker paper and includes side sections 6 which may be joined to the filter material of container 2 at the side edges, for example by gluing. The side sections are thereby formed in strips and are only arranged in an upper area of the side walls so that adjacent to the tip 4 the filter material is not covered by the sections 6. In a further embodiment, container 2 is only connected to the supporting body at the flaps 7".

The supporting body 3 comprises at the side sections 6 pivotable arms or flaps 7", which are each connected to a side section 6 via a folding edge 8. In the embodiment example shown, six flaps 7" are provided, which are essentially triangular in shape and surround an interior of container 2 in the manner of a hexagon. A section of filter material is fixed to the flaps 7", for example by gluing, so that when the flaps 7" move, the filter material is also pivoted. A recess 18 is provided on each flap 7" to facilitate opening. It is also possible to make do without a recess 18 in the area of the flaps 7".

Figure 12:
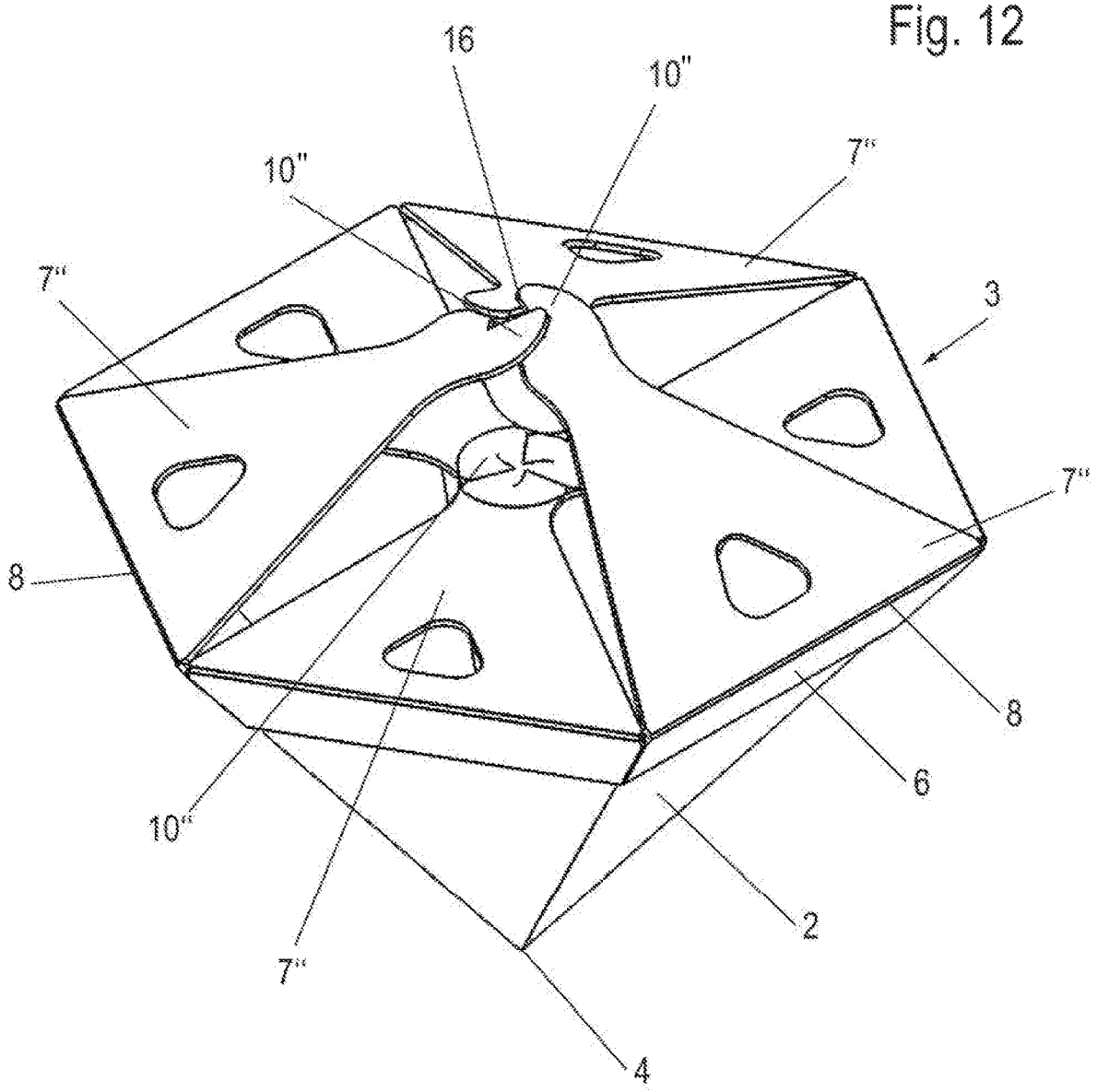
FIGS. 12 to 16 show several views of the portion pack of FIG. 10 during an opening procedure.
Figure 13:
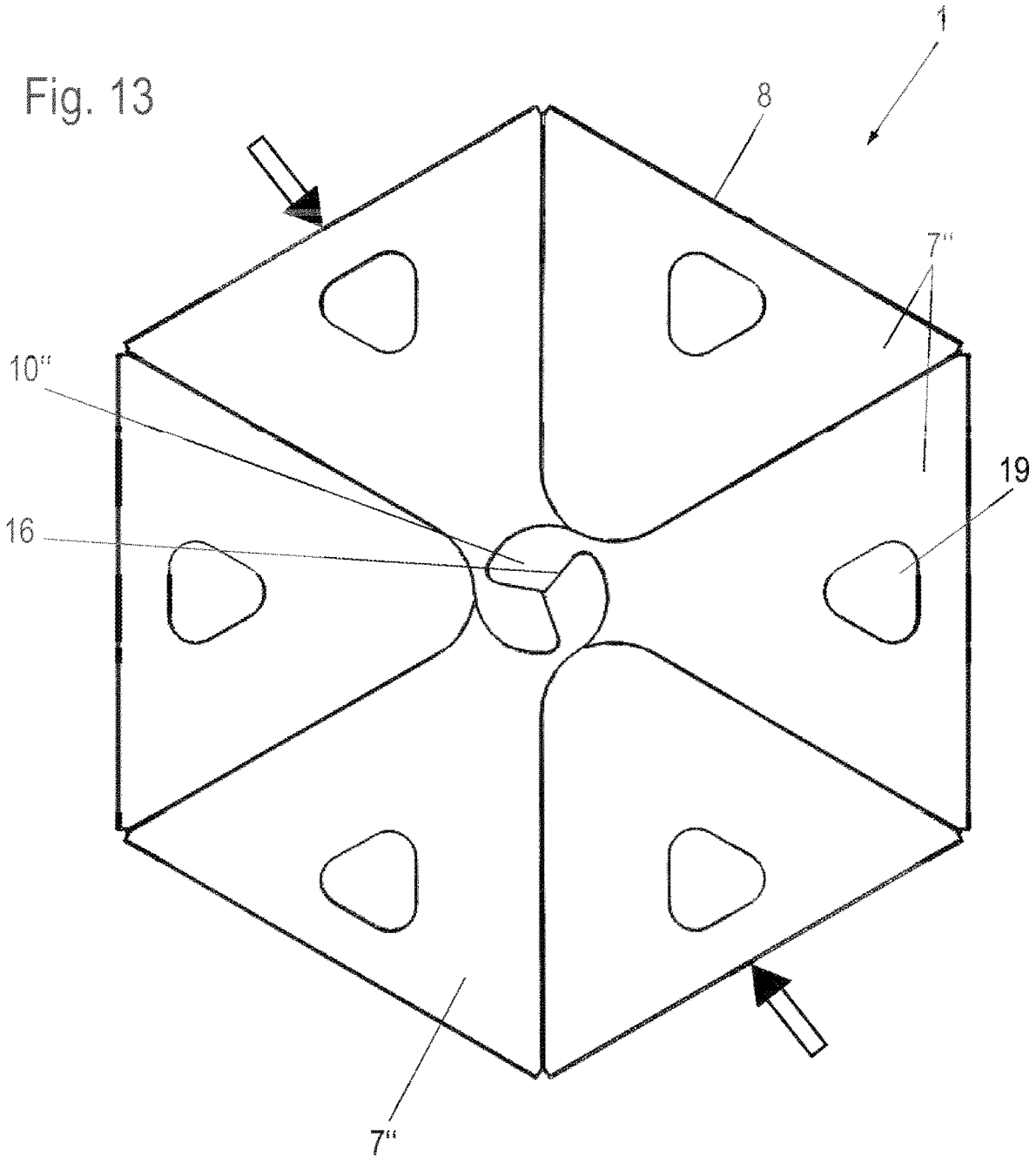

Referring, for example, to FIG. 10, each flap 7" is provided with a closure means 10" at the end, which has a guide edge 16 and a latching projection 17. The closure means 10" of two, three or four flaps 7" can be locked together by folding the closure means 10" on top of each other, for example as shown in FIGS. 12 and 13.

Container 2 contains an extraction material, especially ground coffee or tea.

Figure 11:
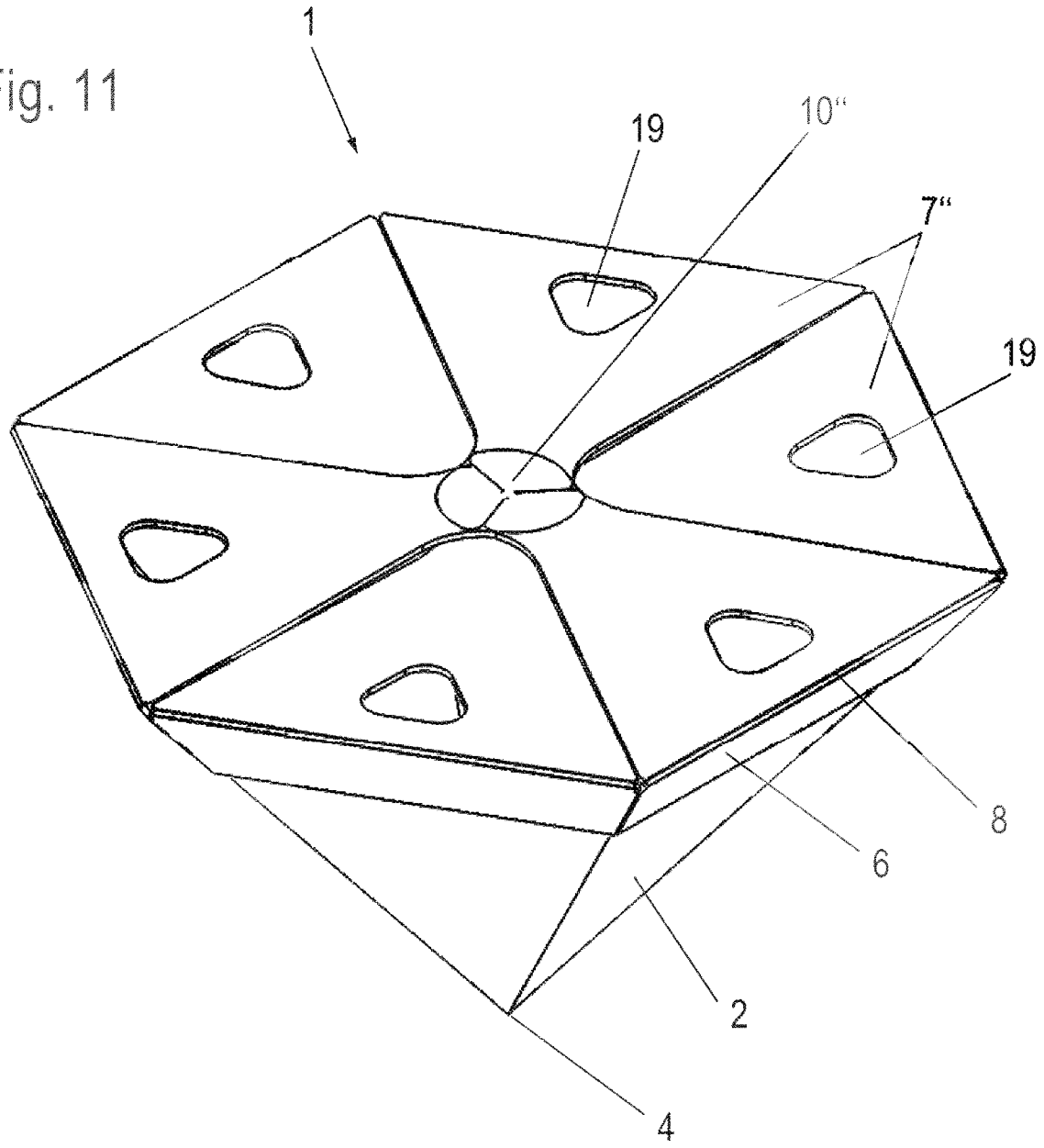
FIG. 11 shows a perspective view of a portion pack in a closed position.

In FIG. 11, portion pack 1 is shown in a closed position in which it is formed in a pyramid-shaped manner. In this way the portion pack 1 can be inserted into a machine for preparing a brewed beverage. Compared to FIG. 10, recesses 19 in FIG. 11 do not extend to the folding ethic 8, but are somewhat smaller, otherwise the embodiment example of FIG. 11 corresponds to FIG. 10. Depending on the desired functionality, the recesses 19 can have different geometries or they can be dispensed with.

The opening procedure is explained in detail with reference to FIGS. 12 to 16. In order to open the portion pack 1, the flap 7" can be opened either manually or by applying a liquid, especially hot water, which causes swelling processes on the supporting body 3 in the area of the folding edges 8 and causes automatic opening.

In FIG. 12, three flaps 7" have been slightly opened, and it can be seen that these three flaps 7" overlap each other in the area of the closure means 10" and can be pivoted together around the respective folding edges 8. In this process, the closure means 10" are unlocked and slide along the guide edges 16. Three further flaps 7" are still in the closed, locked position in FIG. 12, so that in this position the escape of ground coffee is prevented by the three closed flaps 7". In order to explain the opening process, the upper sections 9 of the filter material in FIGS. 12 to 16 have been omitted in the area of the flaps 7". As may be appreciated, in this embodiment the pivotable flaps are arranged in at least two planes one on lop of the other at least in the area of the closure means in the closed position of the portion pack in order to make the closure of the portion pack particularly stable. Also see FIG. 13 in this regard.

In FIG. 13, the portion pack 1 of FIG. 12 is shown in a top view. If portion pack 1 is subjected to an impact or pressure load, as symbolized by the arrows, an opening of the three upper flaps 7" may optionally be produced, whose closing means 10" in the closed position are located above the closing means 10" of the three lower flaps 7". However, portion pack 1 remains closed because the closing means 10" of the three lower flaps 7" remain locked. In case of torsion due to shear load, either the lower or the upper spoke triplet formed by the flaps 7" stabilizes the closure, depending on the direction, since the guide edges 16 and the latching projections 17 are oriented alternately in one or the other direction, as best shown in FIG. 10.

Figure 14:
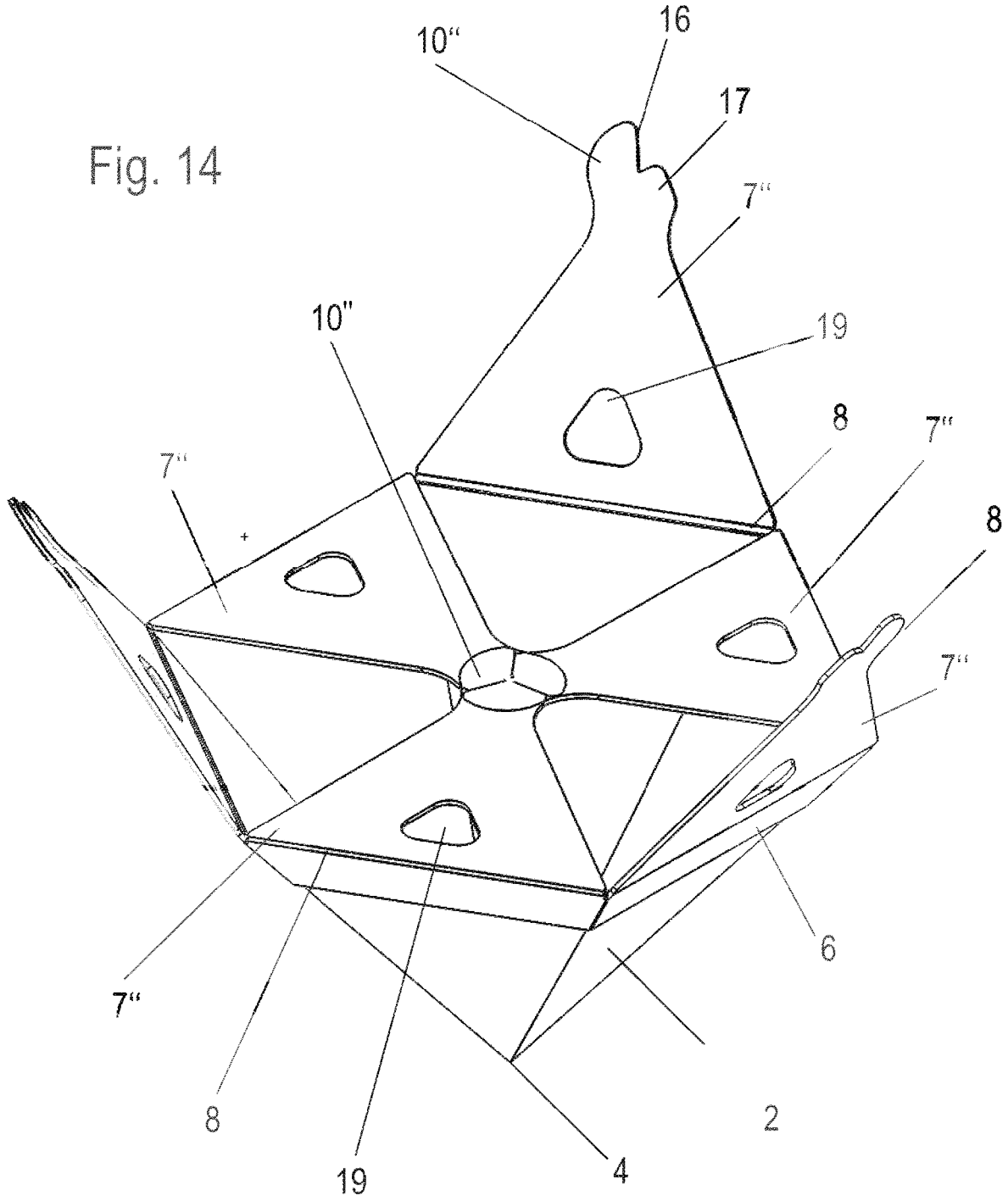

In FIG. 14, the three flaps 7" have been pivoted by more than 90°, while the three lower flaps 7" are still locked by the closure means 10'. It can be seen that the three lower flaps 7" still essentially close the container 2, wherein the filter material in the area of the lower flaps 7" additionally seals the opening on the portion pack 1.

Figure 15:
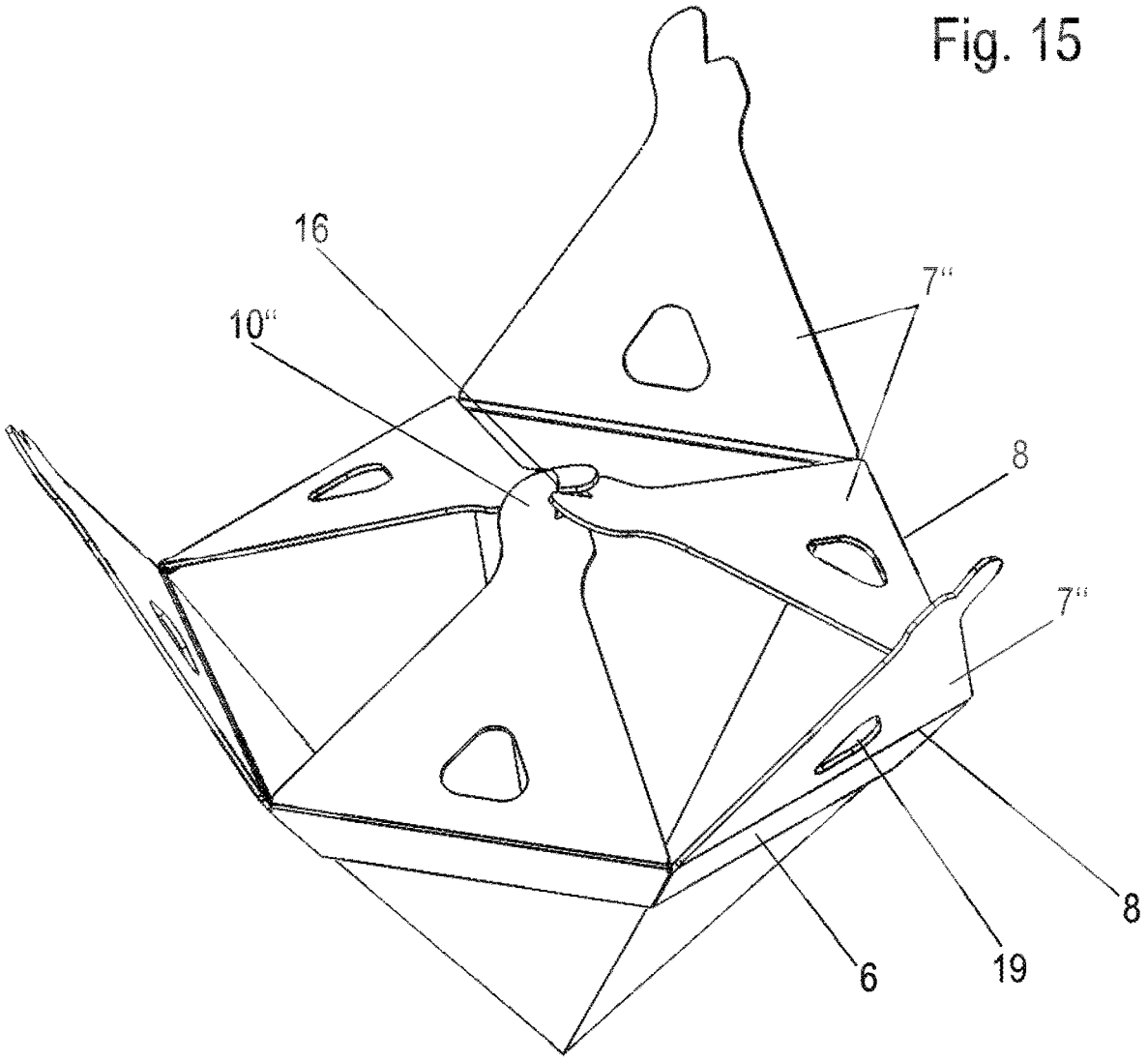
Figure 16:
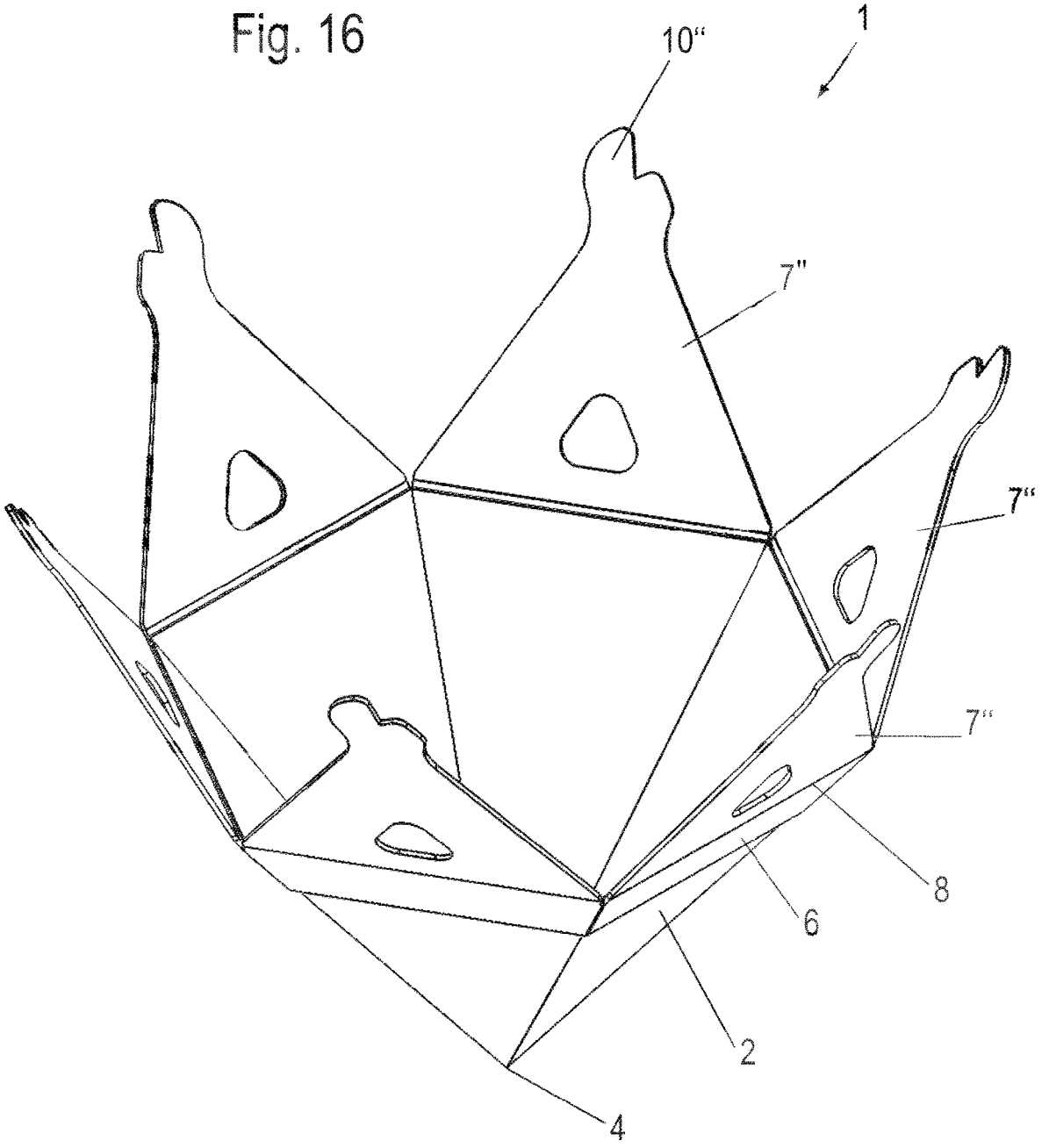

In FIG. 15, the lower flaps 7" are shown in a slightly open position in which the upper closure means 10" is unlocked. In FIG. 16, portion pack 1 is shown in a fully open position, with no filter material in the area of the flaps 7" to allow a better view of the opening mechanism. Furthermore, portion pack 1 is not filled with extraction material.

When portion pack 1 is opened by a liquid is swelling processes, the six flaps 7" are opened substantially simultaneously, wherein the flaps 7" are opened only briefly one after the other with the upper closing means 10", which are arranged above the closing means 10" of the lower flaps 7". The swelling processes cause the flaps 7" to be pivoted essentially simultaneously.

Figure 17:
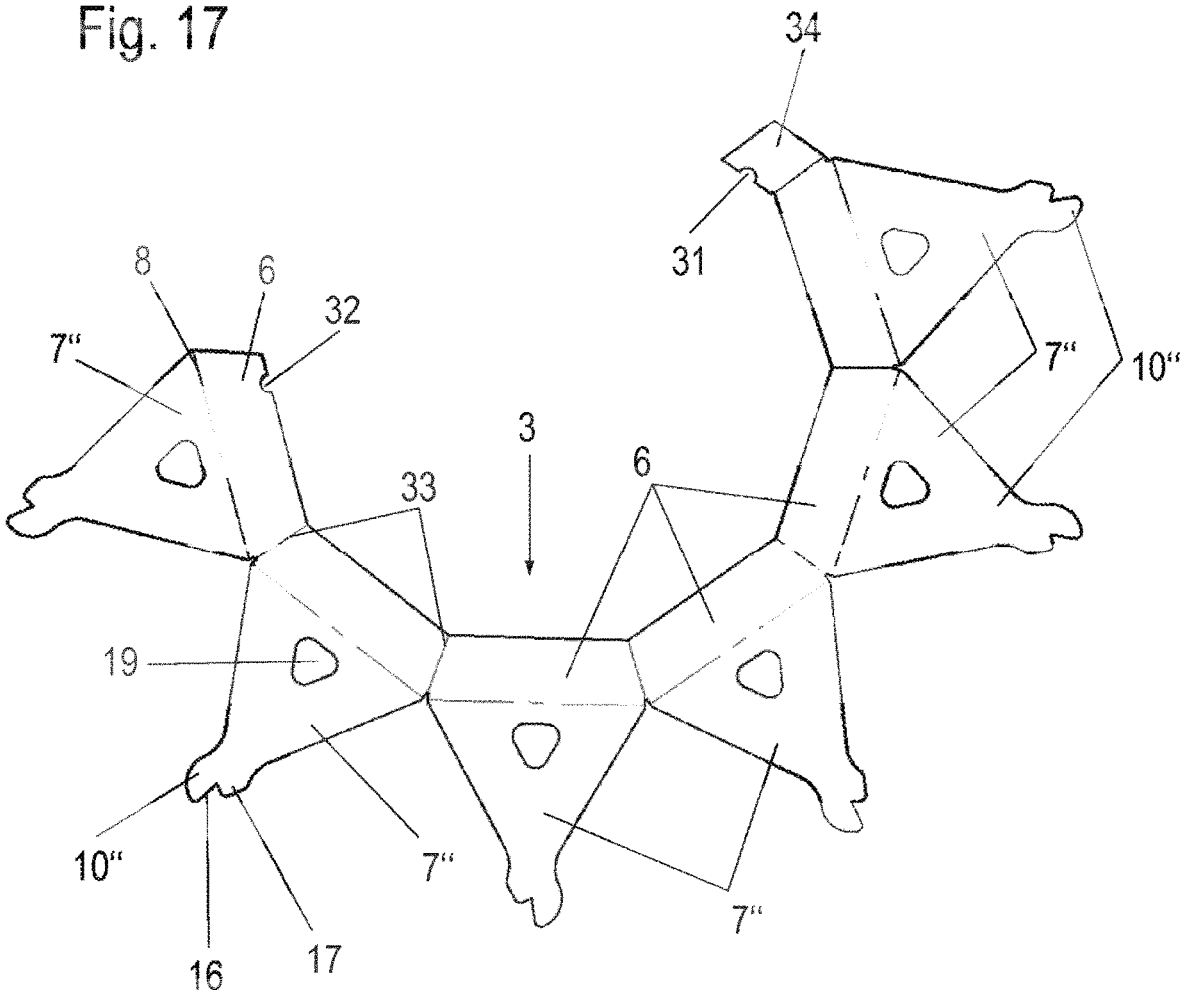
FIG. 17 shows a view of the cut-out of the supporting body for the portion pack of FIGS. 12 to 16.

In FIG. 17 the supporting body 3 is shown in a cut-out. The supporting body 3 is manufactured as an integral component from cardboard and comprises six arms or flaps 7", each of which is connected to a side section 6 via folding edges 8. The side sections 6 can be folded in a ring along folding edges 33, wherein a connecting web 34 is formed on one end section 6, which can be connected to an opposite side section 5, for example by gluing. A recess 31 is provided on the connecting web 34, which can be brought into alignment with a recess 32 on an end side section 5 for aligning the supporting body 3 during gluing. The blank of filter material may also be made in one piece and glued together along a connecting section or joined by stamping to produce a bag-shaped container 2. The supporting body 3 is preferably placed on the outside of the filter material, but can optionally be provided on an inside of the filter material. Furthermore, the number of flaps 7" can also be varied.

The invention claimed is:

1. A method for producing a beverage with a portion pack comprising a container made of filter material in which an extraction material is arranged and a supporting body surrounding the container, wherein the supporting body includes at least one flap hinged to a folding edge of the supporting body, an upper section of the filter material is fixed to the at least one flap, and the at least one flap has a folded position in which the upper section of filter material covers an upper side of the container rendering a closed portion pack, the method comprising the steps of:

inserting the closed portion pack into a filter vessel;

opening the container of the portion pack by pivoting the at least one flap to which the upper section of the filter material is fixed from the folded position to an open position which opens the upper side of the container thereby increasing the inner volume of the container by at least 50% compared to the inner volume in the folded position of the at least one flap; and applying water to the extraction material for beverage preparation.

2. The method according to claim 1, wherein the opening the container includes moistening the portion pack in a region of the folding edge of the at least one folding flap to initiate a swelling process of the supporting body in the region of the folding edge of the at least one folding flap that causes the pivoting of the at least one folding flap which automatically results in the opening of the container of the portion pack.

3. The method according to claim 2, wherein the opening of the container of the portion pack includes applying hot water to moisten the region of the folding edge of the at least one folding flap on the supporting body.

4. The method according to claim 2, wherein the opening of the container includes pivoting the at least one flap of the supporting body on the upper side of the container between 90° and 180° from the closed position to the open position.

5. The method according to claim 1, wherein the opening of the container of the portion pack includes applying water in an amount between 5 mm to 100 mm to the portion pack, and then, after opening the container of the portion pack, applying hot water to the extraction material in the portion pack.

6. A portion pack for the production of a beverage, comprising:

a container comprising filter material in which an extraction material is to be arranged, the container having an upper side and the filter material including at least one upper section covering the upper side in a closed position of the portion pack and being pivotable to uncover the upper side of the container resulting in an open position of the portion pack; and a supporting body surrounding the container at least in some areas, the supporting body including at least one flap pivotable around a folding edge, wherein the at least one upper section of the filter material is fixed to the at least one flap, wherein the inner volume of the container in the open position of the at least one upper section of the filter material is at least 50% greater than the inner volume of the container in the closed position of the upper section of filter material.

7. The portion pack according to claim 6, wherein the folding edge of the at least one flap of the supporting body is adapted to cause the flap to pivot about the folding edge when the folding edge is moistened.

8. The portion pack according to claim 6, wherein the supporting body at least partially comprises cardboard.

9. The portion pack according to claim 6, wherein the folding edge is a circumferential folding edge around the container and is interrupted in regions by respective cutouts.

10. The portion pack according to claim 9, wherein, based on a length of the circumferential folding edge in a region, the respective cutout has a length that occupies between 20% to 50% of the length of the folding edge in that region.

11. The portion pack according to claim 6, wherein at least one flap has a surface that includes a cutout at a distance from the folding edge.

12. The portion pack according to claim 6, wherein the at least one flap comprises at least four flaps which are pivotably mounted on the folding edge.

13. The portion pack according to claim 6, wherein the at least one pivotable flap comprises a plurality of pivotable flaps and the at least one upper section of the filter paper comprises a plurality of upper sections fixed respectively to the plurality of pivotable flaps, and further including a closure means for holding the plurality of pivotable flaps in a closed position, and wherein the plurality of pivotable flaps are arranged in at least two planes, one on top of the other, at least in a region of the closure means in the closed position of the portion pack.

* * * * *